US009852684B2

(12) United States Patent
Toyomura et al.

(10) Patent No.: US 9,852,684 B2
(45) Date of Patent: Dec. 26, 2017

(54) DRIVE CIRCUIT, DISPLAY UNIT, AND ELECTRONIC APPARATUS

(71) Applicant: JOLED Inc., Tokyo (JP)

(72) Inventors: Naobumi Toyomura, Kanagawa (JP); Tetsuro Yamamoto, Kanagawa (JP)

(73) Assignee: JOLED Inc., Tokyo (JP)

( * ) Notice: Subject to any disclaimer, the term of this patent is extended or adjusted under 35 U.S.C. 154(b) by 176 days.

(21) Appl. No.: 14/539,218

(22) Filed: Nov. 12, 2014

(65) Prior Publication Data

US 2015/0154911 A1 Jun. 4, 2015

(30) Foreign Application Priority Data

Nov. 29, 2013 (JP) ..... 2013-247230

(51) Int. Cl.

| | |
|---|---|
| ***G09G 3/32*** | (2016.01) |
| ***G09G 3/3233*** | (2016.01) |
| ***G09G 3/20*** | (2006.01) |

(52) U.S. Cl.

CPC ..... *G09G 3/3233* (2013.01); *G09G 3/20* (2013.01); *G09G 2300/0819* (2013.01); *G09G 2300/0842* (2013.01); *G09G 2300/0861* (2013.01); *G09G 2310/0216* (2013.01); *G09G 2310/0221* (2013.01); *G09G 2320/045* (2013.01)

(58) Field of Classification Search

CPC ..... G09G 3/3258; G09G 3/003; G09G 2320/0626; G02B 27/22

USPC ..... 345/76, 419; 349/51

See application file for complete search history.

(56) References Cited

U.S. PATENT DOCUMENTS

| | | | | |
|---|---|---|---|---|
| 2010/0033461 | A1* | 2/2010 | Hasegawa | H04N 13/0497 345/211 |
| 2010/0033462 | A1* | 2/2010 | Hasegawa | H04N 13/0497 345/211 |
| 2010/0091207 | A1* | 4/2010 | Hasegawa | H04N 13/0438 349/15 |

(Continued)

FOREIGN PATENT DOCUMENTS

| | | | |
|---|---|---|---|
| JP | 2011-133652 | A | 7/2011 |
| JP | 2013-114112 | | 6/2013 |
| WO | 2013-088483 | A1 | 4/2015 |

OTHER PUBLICATIONS

Office Action from Japan Patent Office for application No. JP2013-247230 dated Jul. 4, 2017.

*Primary Examiner* — Yuzhen Shen

(74) *Attorney, Agent, or Firm* — Michael Best & Friedrich LLP

(57) ABSTRACT

Provided is a drive circuit that includes a scanning circuit configured to perform a first vertical scanning and a second vertical scanning on each of first and second display regions, adjacent to each other in a vertical direction in a display region including pixels, individually in one frame. The first vertical scanning causes light emission of each pixel to be performed, and the second vertical scanning causes light extinction of each pixel to be performed. The scanning circuit is configured to perform the first vertical scanning and the second vertical scanning to cause timing of starting the light emission of an n+1th frame for a first scanned row, adjacent to the first display region, in the second display region to be later than timing of ending the light emission of an n-th frame for a final scanned row, adjacent to the second display region, in the first display region.

19 Claims, 12 Drawing Sheets

(56) References Cited

U.S. PATENT DOCUMENTS

| | | | | |
|---|---|---|---|---|
| 2011/0157158 | A1* | 6/2011 | Hasegawa ..... | G02B 27/2264<br>345/419 |
| 2013/0155124 | A1 | 6/2013 | Tsuge | |

* cited by examiner (A) IMAGE DISPLAY IN FIRST DISPLAY REGION 10B (B) IMAGE DISPLAY IN SECOND DISPLAY REGION 10C (C) IMAGE AT TIME Tx

DRIVE CIRCUIT, DISPLAY UNIT, AND ELECTRONIC APPARATUS

CROSS REFERENCE TO RELATED APPLICATIONS

This application claims the benefit of Japanese Priority Patent Application JP2013-247230 filed Nov. 29, 2013, the entire contents of which are incorporated herein by reference.

BACKGROUND

The disclosure relates to a drive circuit in which a display region is divided into a plurality of display regions to drive the divided display regions, and to a display unit and an electronic apparatus each provided with the drive circuit.

In recent years, a display panel is becoming higher in definition, resulting in appearance of a high resolution display such as a 4K2K display. Higher resolution, however, shortens 1H time, which leads to insufficient timing margin attributed to wiring transient and occurrence of image defect accordingly. To address this, for example, a method may be contemplated in which a display region is divided into two regions of an upper display region and a lower display region, and vertical scanning is performed for each of those divided regions to allow transition speed of the vertical scanning to be half the transition speed of vertical scanning performed at once for the entire display region, as disclosed in Japanese Unexamined Patent Application Publication No. 2013-114112.

SUMMARY

Parts (A) to (C) of FIG. 13 illustrate a state according to a comparative example in which a display region 100A is divided into two regions of an upper display region and a lower display region, and a light extinction scanning Sc1 and a light emission scanning Sc2 is performed for each of those divided regions simultaneously, i.e., for each of the display regions 100B and 100C simultaneously. In this state, there is timing Tx at which images belonging to different frames from each other are displayed together at respective regions near a juncture (a part denoted by a broken line in (C) of FIG. 13) of the upper display region 100B and the lower display region 100C. At this time, an image may become discontinuous at the juncture described above when the image is a video image, leading to deterioration of quality of the displayed image.

It is desirable to provide a drive circuit capable of reducing deterioration of quality of a displayed image resulting from higher resolution, and a display unit and an electronic apparatus each provided with the drive circuit.

A drive circuit according to an embodiment of the technology includes: a scanning circuit configured to perform a first vertical scanning and a second vertical scanning on each of a first display region and a second display region individually in one frame, in which the first display region and the second display region are adjacent to each other in a vertical direction in a display region including a plurality of pixels. The first vertical scanning causes light emission of each of the pixels to be performed, and the second vertical scanning causes light extinction of each of the pixels to be performed. The scanning circuit is configured to perform the first vertical scanning and the second vertical scanning to cause timing of starting the light emission of an n+1th frame for a first scanned row in the second display region to be later than timing of ending the light emission of an n-th frame for a final scanned row in the first display region, in which the first scanned row is adjacent to the first display region, and the final scanned row is adjacent to the second display region.

A display unit according to an embodiment of the technology includes: a display panel having a display region, in which the display region includes a plurality of pixels, and a first display region and a second display region that are adjacent to each other in a vertical direction; and a drive circuit configured to drive the pixels, and including a scanning circuit. The scanning circuit is configured to perform a first vertical scanning and a second vertical scanning on each of the first display region and the second display region individually in one frame, in which the first vertical scanning causes light emission of each of the pixels to be performed, and the second vertical scanning causes light extinction of each of the pixels to be performed. The scanning circuit is configured to perform the first vertical scanning and the second vertical scanning to cause timing of starting the light emission of an n+1th frame for a first scanned row in the second display region to be later than timing of ending the light emission of an n-th frame for a final scanned row in the first display region, in which the first scanned row is adjacent to the first display region, and the final scanned row is adjacent to the second display region.

An electronic apparatus according to an embodiment of the technology includes a display unit. The display unit includes: a display panel having a display region, in which the display region includes a plurality of pixels, and a first display region and a second display region that are adjacent to each other in a vertical direction; and a drive circuit configured to drive the pixels, and including a scanning circuit. The scanning circuit is configured to perform a first vertical scanning and a second vertical scanning on each of the first display region and the second display region individually in one frame, in which the first vertical scanning causes light emission of each of the pixels to be performed, and the second vertical scanning causes light extinction of each of the pixels to be performed. The scanning circuit is configured to perform the first vertical scanning and the second vertical scanning to cause timing of starting the light emission of an n+1th frame for a first scanned row in the second display region to be later than timing of ending the light emission of an n-th frame for a final scanned low in the first display region, in which the first scanned row is adjacent to the first display region, and the final scanned low is adjacent to the second display region.

In the drive circuit, the display unit, and the electronic apparatus according to the above-described embodiments of the technology, the timing of starting the light emission of the n+1th frame for the first scanned row in the second display region is later than the timing of ending the light emission of the n-th frame for the final scanned low in the first display region. This prevents a light emission period of the n+1th frame for the first scanned row in the second display region and a light emission period of the n-th frame for the final scanned row in the first display region from being overlapped with each other.

According to the drive circuit, the display unit, and the electronic apparatus in the above-described embodiments of the technology, the timing of starting the light emission of the n+1th frame for the first scanned row in the second display region is later than the timing of ending the light emission of the n-th frame for the final scanned row in the first display region, making it possible to reduce deterioration of quality of a displayed image due to discontinuity of images at a juncture. Hence, it is possible to reduce deterioration of quality of a displayed image resulting from higher resolution.

It is to be noted that what is described above is one example of the technology. Also, effects of the technology are not limited to those described above. Effects achieved by the technology may be those that are different from the above-described effects, or may include other effects in addition to those described above. Further, it is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

In the following, some example embodiments of the technology are described in detail in the following order with reference to the accompanying drawings.

1. Embodiment (display unit)
2. Modification examples (display unit)
3. Application examples (electronic apparatus)

First Embodiment

[Configuration]

Figure 1:
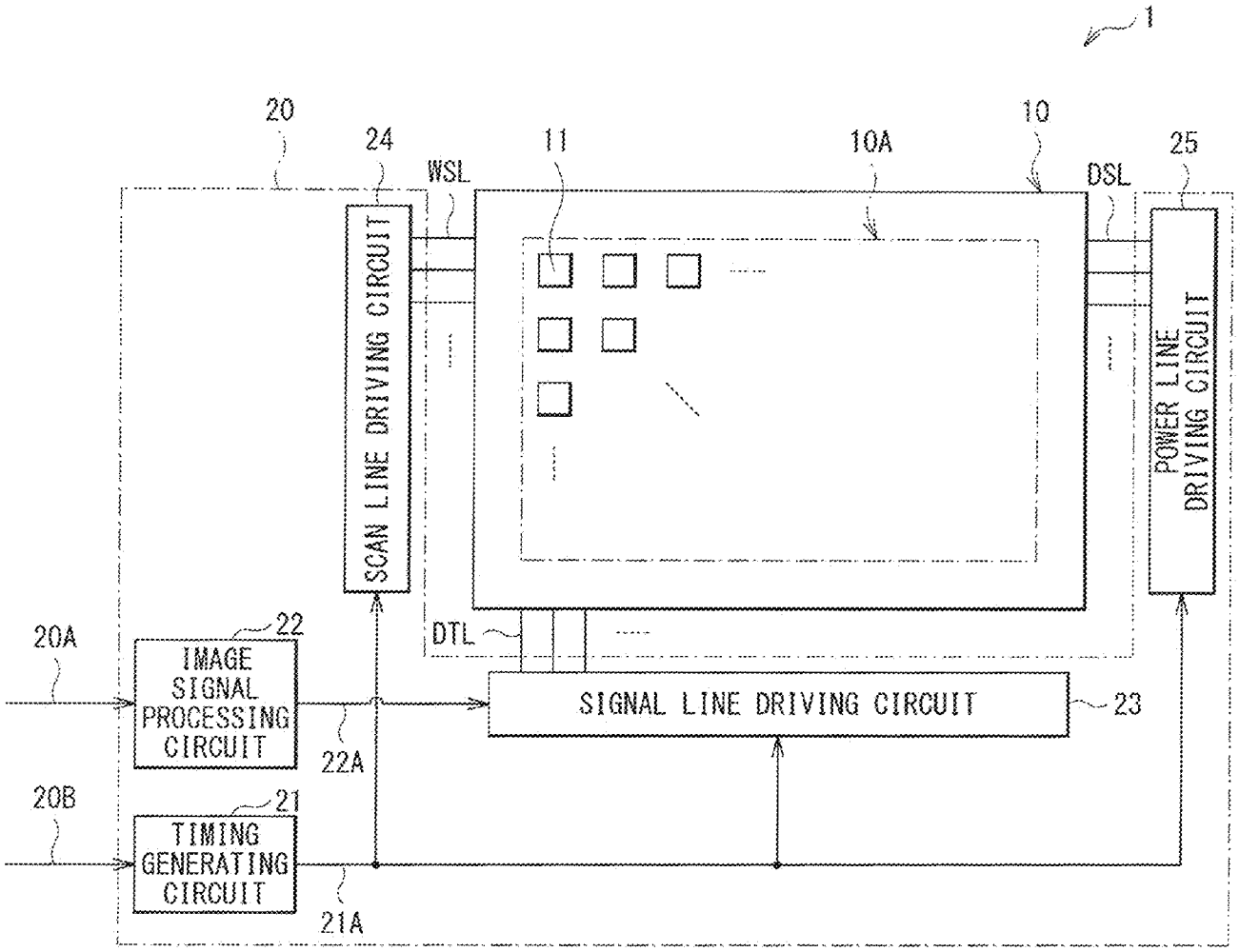
FIG. 1 illustrates a schematic configuration of a display unit according to an embodiment of the technology.

FIG. 1 illustrates a schematic configuration of a display unit 1 according to an embodiment of the technology. The display unit 1 includes a display panel 10 and a drive circuit 20 configured to drive the display panel 10, based on an image signal 20A and a synchronizing signal 20B that may be supplied from the outside. The drive circuit 20 may include a timing generating circuit 21, an image signal processing circuit 22, a signal line driving circuit 23, a scan line driving circuit 24, and a power line driving circuit 25, for example.

[Display Panel 10]

The display panel 10 has a configuration in which a plurality of pixels 11 are arranged in matrix over the entire display region 10A of the display panel 10. The display panel 10 may display an image based on the image signal 20A supplied from the outside, through active-matrix driving of each of the pixels 11 performed by the drive circuit 20.

Figure 2:
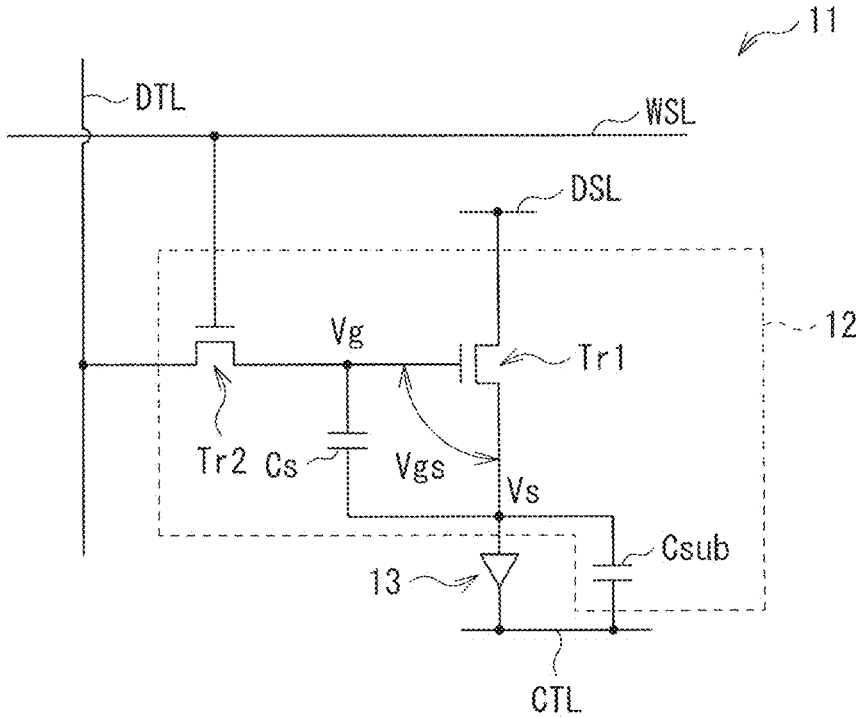
FIG. 2 illustrates an example of a circuit configuration of each pixel.

FIG. 2 illustrates an example of a circuit configuration of each of the pixels 11. The pixels 11 each may include a pixel circuit 12 and an organic electroluminescence (EL) element 13, for example. The organic EL element 13 may have a configuration in which an anode electrode, an organic layer, and a cathode layer are stacked in order, for example. The organic EL element 13 includes an unillustrated element capacitance Coled. The pixel circuit 12 controls light emission and light extinction of the organic EL element 13. The pixel circuit 12 has a function of retaining a voltage written into each of the pixels 11 by write scanning S3 to be described later. For example, the pixel circuit 12 may be configured by a drive transistor Tr1, a write transistor Tr2, a retention capacitor Cs, and a sub-capacitor Csub, and may thus have a circuit configuration of 2Tr2C.

The write transistor Tr2 controls application of a signal voltage to a gate of the drive transistor Tr1. The signal voltage corresponds to the image signal. The write transistor Tr2 samples a voltage of a signal line DTL to be described later, and writes the voltage of the signal line DTL to the gate of the drive transistor Tr1. The drive transistor Tr1 drives the organic EL element 13, and is connected in series to the organic EL element 13. The drive transistor Tr1 controls a current flowing through the organic EL element 13 depending on magnitude of the voltage written by the write transistor Tr2. The retention capacitor Cs retains a predetermined voltage between the gate and a source of the drive transistor Tr1. The retention capacitor Cs has a function of retaining a gate-source voltage Vgs of the drive transistor Tr1 at a constant value during a waiting period to be described later. The sub-capacitor Csub supplies part of a current supplied from the drive transistor Tr1. Note that the pixel circuit 12 may have a circuit configuration in which various capacitors and transistors are added to the above-described circuit configuration of 2Tr2C, or may have a circuit configuration different from the above-described circuit configuration of 2Tr2C.

Each of the drive transistor Tr1 and the write transistor Tr2 may be, for example, an n-channel MOS thin-film transistor (TFT). Note that the type of TFT of each of the drive transistor Tr1 and the write transistor Tr2 is not particularly limited. In one embodiment, one or both of the drive transistor Tr1 and the write transistor Tr2 may have an inverted-staggered structure or a so-called bottom gate structure, or may have a staggered structure or a so-called top gate structure. Also, one or both of the drive transistor Tr1 and the write transistor Tr2 may be a p-channel MOS TFT.

The display panel 10 has a plurality of scan lines WSL each extending in a row direction, a plurality of signal lines DTL each extending in a column direction, a plurality of power lines DSL each extending in the row direction, and a plurality of cathode lines CTL each extending in the row direction. The cathode lines CTL may be formed of one common sheet metal layer. The scan lines WSL are used to select the respective pixels 11. The signal lines DTL are used to supply the signal voltage corresponding to the image signal, to the respective pixels 11. The power lines DSL are used to supply a drive current to the respective pixels 11.

The pixel 11 is provided near an intersection between each of the signal lines DTL and each of the scan lines WSL. Each of the signal lines DTL is connected to an output end (not illustrated) of the signal line driving circuit 23 to be described later and to a source or a drain of the write transistor Tr2. Each of the scan lines WSL is connected to an output end (not illustrated) of the scan line driving circuit 24 to be described later and to a gate of the write transistor Tr2. Each of the power lines DSL is connected to an output end (not illustrated) of a power source configured to output a fixed voltage and to the source or a drain of the drive transistor Tr1. For example, the cathode lines CTL may be connected to members that are provided around the display region 10A and have a reference voltage.

The gate of the write transistor Tr2 is connected to the scan line WSL. The source or the drain of the write transistor Tr2 is connected to the signal line DTL. A terminal not connected to the signal line DTL out of the source and the drain of the write transistor Tr2 is connected to the gate of the drive transistor Tr1. The source or the drain of the drive transistor Tr1 is connected to the power line DSL. A terminal not connected to the power line DSL out of the source and the drain of the drive transistor Tr1 is connected to an anode of the organic EL element 13. A first end of the retention capacitor Cs is connected to the gate of the drive transistor Tr1. A second end of the retention capacitor Cs is connected to the source (a terminal on the organic EL element 13 side in FIG. 2) of the drive transistor Tr1. In other words, the retention capacitor Cs is inserted between the gate and the source of the drive transistor Tr1. A first end of the sub-capacitor Csub is connected to the source (the terminal on the organic EL element 13 side in FIG. 2) of the drive transistor Tr1. A second end of the sub-capacitor Csub is connected to the cathode line CTL.

[Drive Circuit 20]

Next, a description is given of the drive circuit 20. As described above, for example, the drive circuit 20 may include the timing generating circuit 21, the image signal processing circuit 22, the signal line driving circuit 23, the scan line driving circuit 24, and the power line driving circuit 25. The timing generating circuit 21 controls the circuits in the drive circuit 20 such that the circuits operate in conjunction with one another. For example, the timing generating circuit 21 may output a control signal 21A to the above-described respective circuits in response to (in synchronization with) the synchronizing signal 20B input from the outside.

The image signal processing circuit 22 may perform predetermined correction on the digital image signal 20A input from the outside, and outputs an image signal 22A thus obtained to the signal line driving circuit 23, for example. Examples of the predetermined correction may include, for example, gamma correction and overdrive correction.

The signal line driving circuit 23 may apply an analog signal voltage to the respective signal lines DTL in response to (in synchronization with) the input of the control signal 21A, for example. The analog signal voltage corresponds to the image signal 22A input from the image signal processing circuit 22. For example, the signal line driving circuit 23 is capable of outputting two kinds of voltages (Vofs and Vsig). The signal line driving circuit 23 supplies the two kinds of voltages (Vofs and Vsig) to the pixel 11 selected by the scan line driving circuit 24, through the signal line DTL. The voltage Vsig has a voltage value corresponding to the image signal 20A. The voltage Vofs is a constant voltage not relating to the image signal 20A. A minimum voltage of the voltage Vsig is lower than the voltage Vofs, and a maximum voltage of the voltage Vsig is higher than the voltage Vofs.

The scan line driving circuit 24 may select the plurality of scan lines WSL by a predetermined sequence in response to (in synchronization with) the input of the control signal 21A to perform Vth correction, writing of the signal voltage Vsig, μ correction, and waiting in a desired order, for example. As used herein, the term "Vth correction" refers to correction operation of making the gate-source voltage Vgs of the drive transistor Tr1 close to the threshold voltage of the drive transistor Tr1. The wording "writing of the signal voltage Vsig (the signal writing)" refers to operation of writing the signal voltage Vsig to the gate of the drive transistor Tr1 through the write transistor Tr2. The term "μ correction" refers to operation of correcting the voltage retained between the gate and the source of the drive transistor Tr1 (the gate-source voltage Vgs), based on the magnitude of a mobility μ of the drive transistor Tr1. The signal writing and the μ correction may be performed at timings different from each other in some cases. In the present embodiment, the scan line driving circuit 24 outputs one selection pulse to the scan line WSL to perform the signal writing and the μ correction at the same time (or successively with no pause). The term "waiting" refers to performing of waiting while starting of light emission is possible (i.e., maintaining a light extinction state).

The scan line driving circuit 24 may be capable of outputting two kinds of voltages (Von and Voff), for example. The scan line driving circuit 24 supplies the two kinds of voltages (Von and Voff) to the pixel 11 to be driven, through the scan line WSL, to perform on-off control of the write transistor Tr2. The voltage Von has a value equal to or larger than an on-voltage of the write transistor Tr2. The voltage Von is equivalent to a crest value of a write pulse that is output from the scan line driving circuit 24 during latter half of "Vth correction preparation period", "Vth correction period", "signal writing-μ correction period", and the like that will be described later. The voltage Voff has a value lower than the on-voltage of the write transistor Tr2, and is lower than the voltage Von. The voltage Voff is equivalent to a crest value of the write pulse that is output from the scan line driving circuit 24 during first half of "Vth correction preparation period", "Vth correction suspension period", "waiting period", "light emission period" and the like that will be described later.

The power line driving circuit 25 may sequentially select the plurality of power lines DSL on a predetermined unit basis in response to (in synchronization with) the input of the control signal 21A, for example. The power line driving circuit 25 is capable of outputting two kinds of voltages (Vcc and Vss), for example. The power line driving circuit 25 supplies the two kinds of voltages (Vcc and Vss) to the pixel 11 selected by the scan line driving circuit 24, through the power line DSL. The voltage Vss has a voltage value lower than a voltage (Vel+Vcath) that is sum of the threshold voltage Vel of the organic EL element 13 and a cathode voltage Vcath of the organic EL element 13. The voltage Vcc has a voltage value equal to or larger than the voltage (Vel+Vcath).

[Operation]

Next, a description is given of an example operation (operation from light extinction to light emission) of the display unit 1 according to the present embodiment. In the present embodiment, compensating operation to variation of I-V characteristics of the organic EL element 13 is incorporated in order to maintain constant light emission luminance of the organic EL element 13 without being affected by temporal change of the I-V characteristics of the organic EL element 13 even when such temporal change occurs. Further, in the present embodiment, compensating operation to variation of the threshold voltage and the mobility is incorporated in order to maintain constant light emission luminance of the organic EL element 13 without being affected by the temporal change of the threshold voltage and the mobility of the drive transistor Tr1 even when such temporal change occurs.

Figure 3:
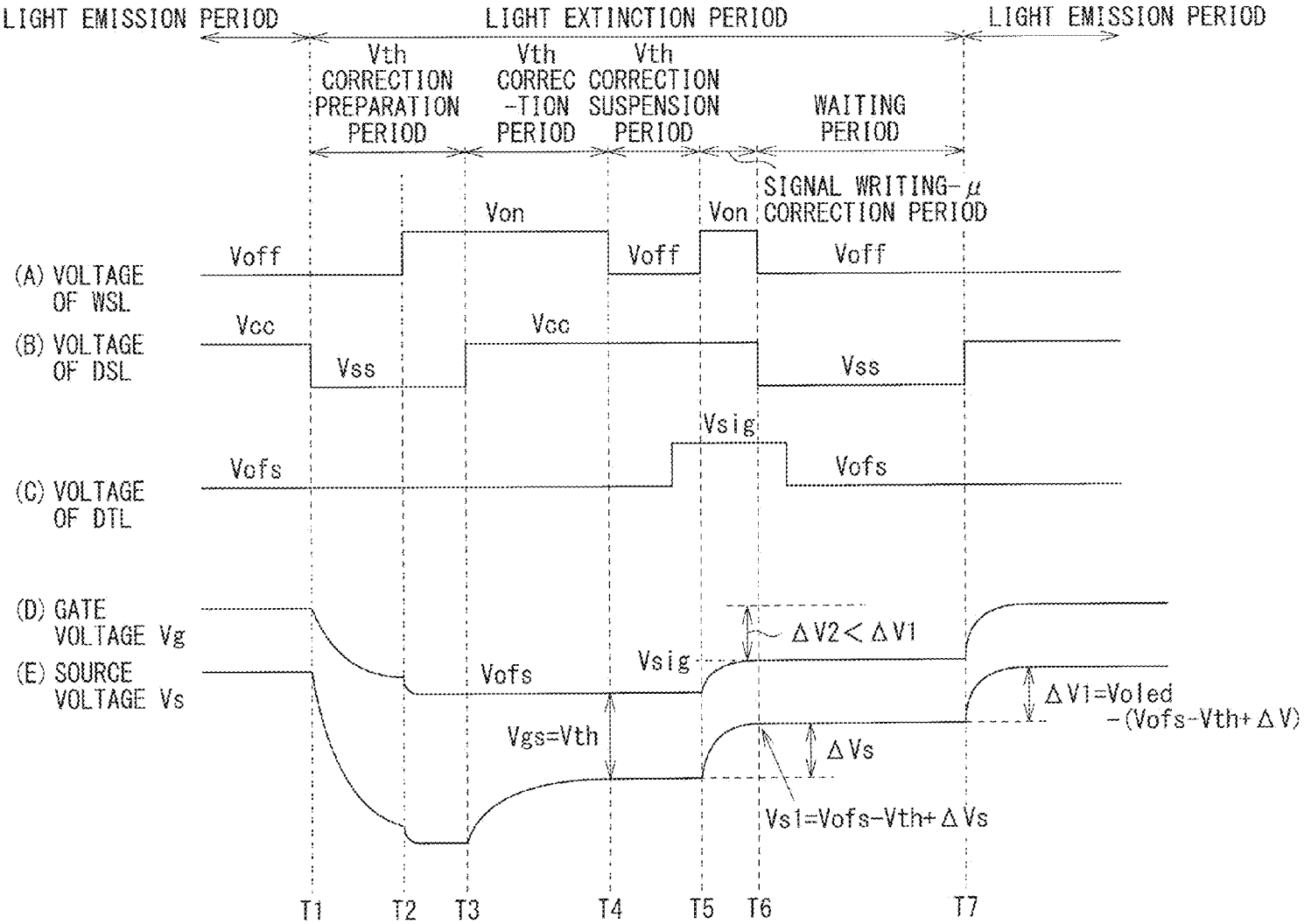
FIG. 3 is a waveform chart illustrating an example, in a pixel, of temporal changes in voltages applied to respective lines of WSL, DSL, and DTL, in a gate voltage, and in a source voltage.

FIG. 3 illustrates an example of temporal changes in voltages applied to the scan line WSL, the power line DSL, and the signal line DTL, in the gate voltage Vg, and in the source voltage Vs in one pixel 11.

[Vth Correction Preparation Period]

First, the drive circuit 20 performs preparation of the Vth correction that makes the gate-source voltage Vgs of the drive transistor Tr1 close to the threshold voltage of the drive transistor Tr1. When the voltage of the scan line WSL is Voff, the voltage of the signal line DTL is Vofs, and the voltage of the power line DSL is Vcc, the power line driving circuit 25 lowers the voltage of the power line DSL from Vcc to Vss in response to the control signal 21A (at a time T1). In other words, when the organic EL element 13 emits light, the power line driving circuit 25 lowers the voltage of the power line DSL from Vcc to Vss in response to the control signal 21A. This decreases the source voltage Vs to Vss, which places the organic EL element 13 in a light extinction state. At this time, the gate voltage Vg is also decreased by coupling through the retention capacitor Cs.

Next, while the voltage of the power line DSL is Vss and the voltage of the signal line DTL is Vofs, the scan line driving circuit 24 raises the voltage of the scan line WSL from Voff to Von in response to the control signal 21A (at a time T2). This decreases the gate voltage Vg to Vofs. Here, a potential difference between the gate voltage Vg and the source voltage Vs (the gate-source voltage Vgs) may be smaller than the threshold voltage of the drive transistor Tr1, or may be equal to or larger than the threshold voltage of the drive transistor Tr1.

[Vth Correction Period]

Next, the drive circuit 20 performs the Vth correction. While the voltage of the signal line DTL is Vofs and the voltage of the scan line WSL is Von, the power line driving circuit 25 raises the voltage of the power line DSL from Vss to Vcc in response to the control signal 21A (at a time T3). This causes a current Ids to flow between the drain and the source of the drive transistor Tr1, which raises the source voltage Vs. Here, when the source voltage Vs is lower than Vofs-Vth, the current Ids flows between the drain and the source of the drive transistor Tr1 until the drive transistor Tr1 is cut off. In other words, when the Vth correction is not completed, the current Ids flows between the drain and the source of the drive transistor Tr1 until the gate-source voltage Vgs becomes Vth. Accordingly, the gate voltage Vg becomes Vofs and the source voltage Vs rises. As a result, the retention capacitor Cs is charged to Vth, and the gate-source voltage Vgs becomes Vth.

Thereafter, the scan line driving circuit 24 lowers the voltage of the scan line WSL from Von to Voff in response to the control signal 21A (at a time T4) before the signal line driving circuit 23 switches the voltage of the signal line DTL from Vofs to Vsig in response to the control signal 21A. This puts the gate of the drive transistor Tr1 into a floating state, allowing the gate-source voltage Vgs to be maintained to Vth irrespective of the magnitude of the voltage of the signal line DTL. In this way, setting the gate-source voltage Vgs to Vth makes it possible to eliminate variation in the light emission luminance of the organic EL element 13 even when the threshold voltage Vth of the drive transistor Tr1 is varied for each pixel circuit 12.

[Vth Correction Suspension Period]

Then, during the Vth correction suspension period, the signal line driving circuit 23 switches the voltage of the signal line DTL from Vofs to Vsig.

[Signal Writing-μ Correction Period]

After the Vth correction suspension period is ended (i.e., after the Vth correction is completed), the drive circuit 20 performs writing of the signal voltage based on the image signal 20A, and performs the μ correction. While the voltage of the signal line DTL is Vsig and the voltage of the power line DSL is Vcc, the scan line driving circuit 24 raises the voltage of the scan line WSL from Voff to Von in response to the control signal 21A (at a time T5). This causes the gate of the drive transistor Tr1 to be connected to the signal line DTL, and the gate voltage Vg of the drive transistor Tr1 becomes the voltage Vsig of the signal line DTL. Here, the anode voltage of the organic EL element 13 is still lower than the threshold voltage Vel of the organic EL element 13 at this stage, and the organic EL element 13 is cut off. Hence, the current Ids flows to the element capacitance Coled of the organic EL element 13 and the sub-capacitor Csub, charging the element capacitance Coled and the sub-capacitor Csub. As a result, the source voltage Vs rises by ΔVs, and the gate-source voltage Vgs eventually becomes Vsig+Vth-ΔVs. In this way, the μ correction is performed at the same time as the writing. Here, ΔVs becomes larger as the mobility μ of the drive transistor Tr1 is larger. Hence, variation in the mobility μ for each pixel 11 is allowed to be eliminated by making the gate-source voltage Vgs small by ΔVs before the light emission.

[Waiting Period]

Then, the drive circuit 20 performs the waiting. The scan line driving circuit 24 lowers the voltage of the scan line WSL from Von to Voff in response to the control signal 21A, and the power line driving circuit 25 lowers the voltage of the power line DSL from Vcc to Vss in response to the control signal 21A (at a time T6). Note that the timing at which the voltage of the power line DSL is lowered from Vcc to Vss may be the same as the timing at which the voltage of the scan line WSL is lowered from Von to Voff, or may be slightly later than the timing at which the voltage of the scan line WSL is lowered from Von to Voff. This puts the gate of the drive transistor Tr1 into a floating state; however, because the voltage of the power line DSL is lowered to Vss, the voltage equal to or larger than the threshold voltage Vel is not applied to the organic EL element 13, and thus the organic EL element 13 does not emit light. The gate-source voltage Vgs at this time is still the voltage defined by Vsig+Vth-ΔVs.

[Light Emission Period]

Finally, the power line driving circuit 25 raises the voltage of the power line DSL from Vss to Vcc in response to the control signal 21A (at a time T7). This causes the current Ids to flow between the drain and the source of the drive transistor Tr1, which raises the source voltage Vs. As a result, the voltage equal to or larger than the threshold voltage Vel is applied to the organic EL element 13, and thus the organic EL element 13 emits light at a desired luminance.

Figure 4:
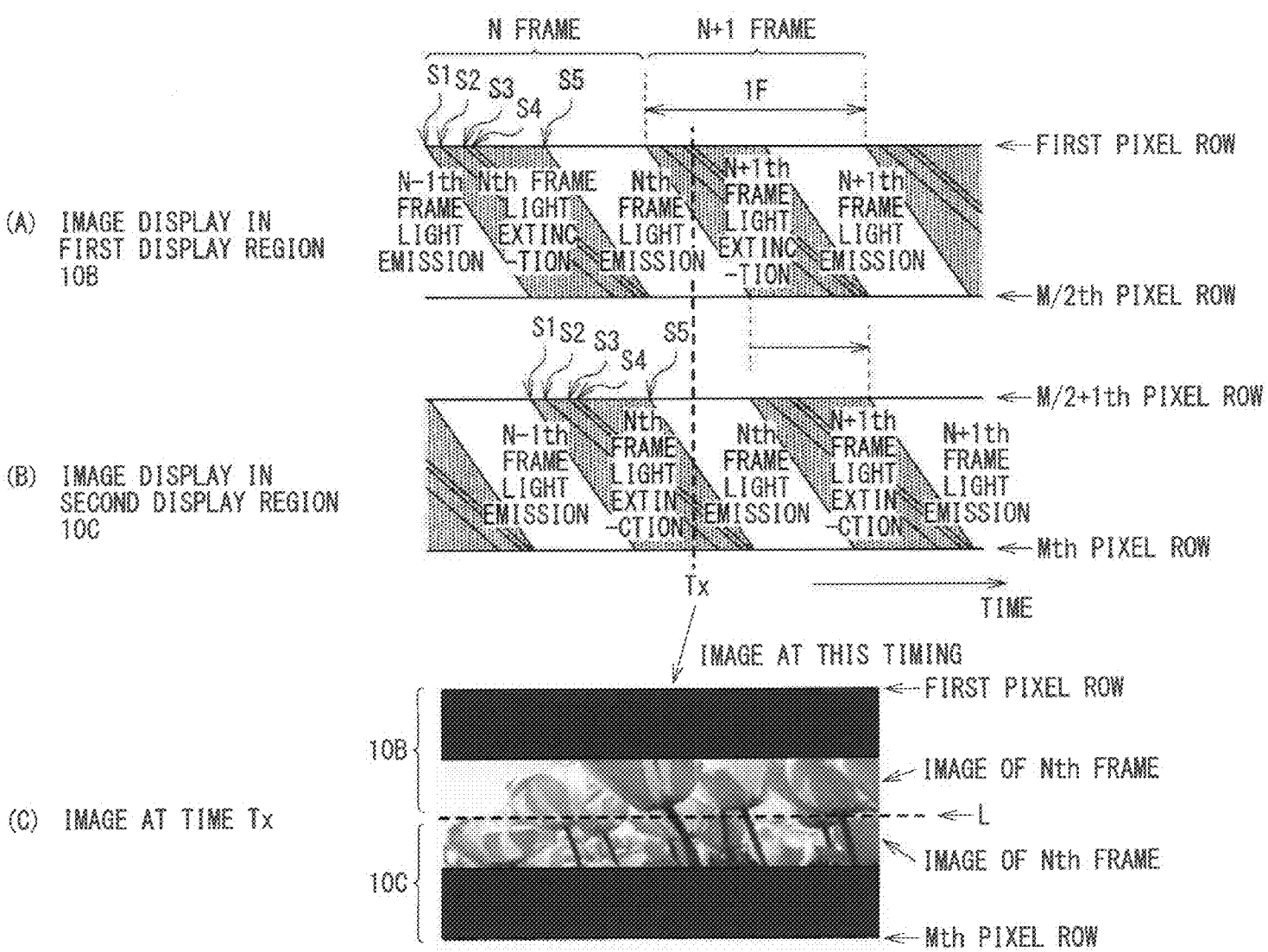
FIG. 4 illustrates an example of image display in each of upper and lower display regions where a display region is divided into two regions of the upper display region and the lower display region.
Figure 5:
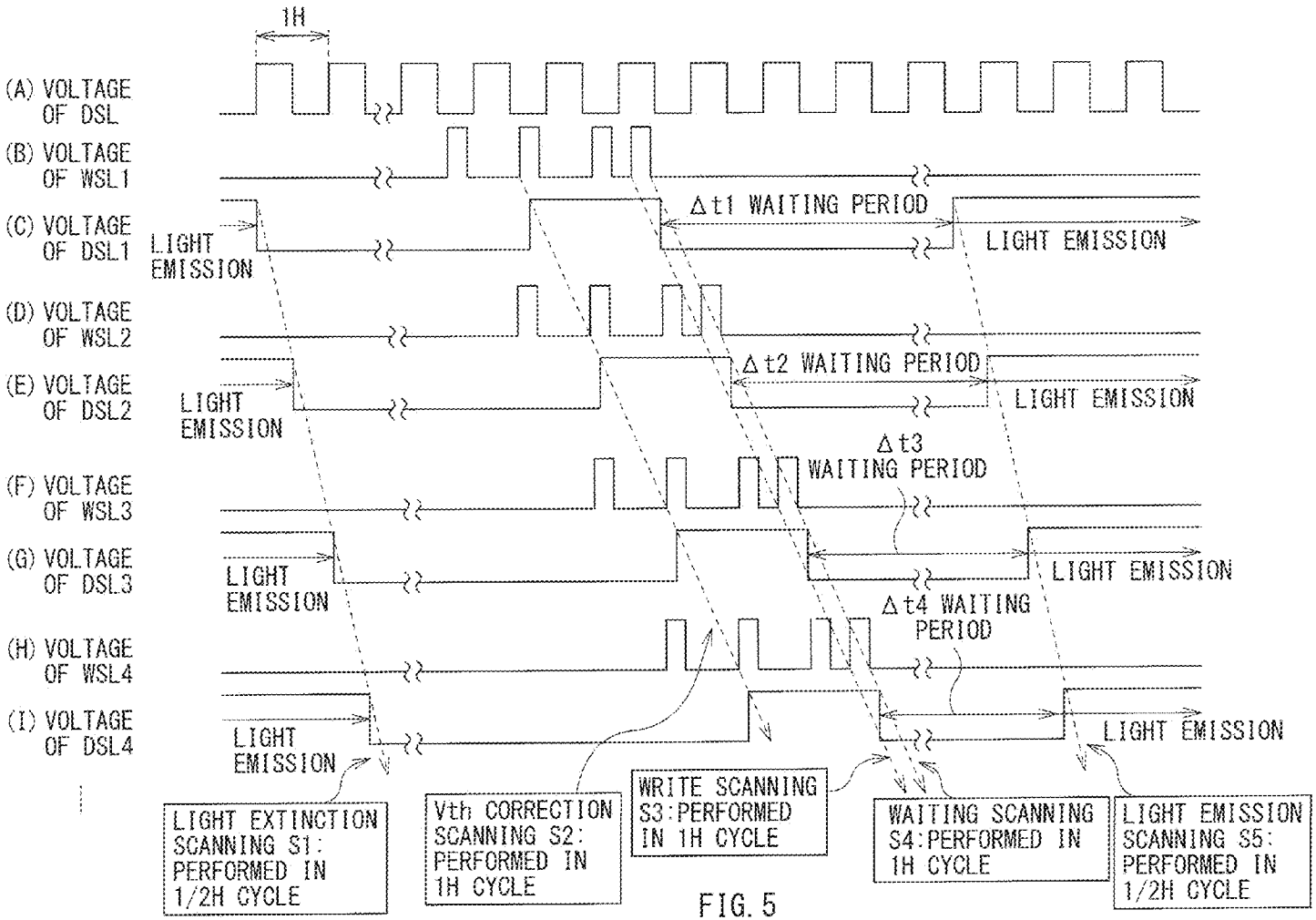
FIG. 5 is a waveform chart illustrating an example, in the upper display region, of temporal changes in voltages applied to respective lines of WSL1 to WSL4, DSL1 to DSL4, and DSL, where the display region is divided into two regions of the upper display region and the lower display region.

FIG. 4 illustrates an example of image display in each of an upper display region (first display region 10B) and a lower display region (second display region 10C) where the display region 10A is divided into two regions of the upper display region and the lower display region. FIG. 5 is a waveform chart illustrating an example, in the first display region 10B, of temporal changes in voltages applied to respective lines of WSL1 to WSL4, DSL1 to DSL4, and DSL.

In the present embodiment, the display region 10A is divided into the first display region 10B and the second display region 10C that are adjacent to each other in a vertical direction. The display region 10A includes M-number of pixel rows. The first display region 10B and the second display region 10C each include M/2 number of pixels rows. In the first display region 10B, a first pixel row serves as a first pixel row of the display region 10A, and a final pixel row (i.e., a pixel row adjacent to the second display region 10C) serves as an M/2th pixel row of the display region 10A. In the second display region 10C, a first pixel row (i.e., a pixel row adjacent to the first display region 10B) serves as an M/2+1th pixel row of the display region 10A, and a final pixel row serves as a final pixel row (i.e., an M-th pixel row) of the display region 10A.

The drive circuit 20 performs vertical scanning of the first display region 10B from the first pixel row to the M/2th pixel row, and vertical scanning of the second display region 10C from the M/2+1th pixel row to the M-th pixel row. The drive circuit 20 may perform the following various vertical scanning operations (1) to (5) on the first display region 10B and the second display region 10C, for each of the first display region 10B and the second display region 10C individually in one frame:

(1) Light extinction scanning S1 performing light extinction of each pixel 11 (second vertical scanning);
(2) Vth correction scanning S2 performing Vth correction;
(3) Write scanning S3 writing a voltage corresponding to an image signal to each pixel 11 and performing μ correction (third vertical scanning);
(4) Waiting scanning S4 causing each pixel 11 to wait to perform light emission following write scanning Sc1 (fourth vertical scanning); and
(5) Light emission scanning S5 performing light emission of each pixel 11 (first vertical scanning).

The drive circuit 20 so performs the light emission scanning S5 and the light extinction scanning S1 as to cause timing of starting light emission of an n+1th frame for a first scanned row in the second display region 10C (i.e., the M/2+1th pixel row) to be later than timing of ending light emission of an n-th frame for a final scanned row in the first display region 10B (i.e., the M/2th pixel row), where "n" is a positive integer variable. This prevents a light emission period of the n+1th frame for the first scanned row (i.e., the M/2+1th pixel row) in the second display region 10C and a light emission period of the n-th frame for the final scanned row (i.e., the M/2th pixel row) in the first display region 10B from being overlapped with each other.

Further, the drive circuit 20 may so perform the light emission scanning S5 and the light extinction scanning S1 as to cause a light emission period of the n-th frame for the final scanned row in the first display region 10B and a light emission period of an n-th frame for the first scanned row in the second display region 10C to be entirely or partially overlapped with each other. In the present embodiment, the final scanned row in the first display region 10B is the M/2th pixel row, and the first scanned row in the second display region 10C is the M/2+1th pixel row. As illustrated in (A) and (B) of FIG. 4, the drive circuit 20 may perform the light emission scanning S5 and the light extinction scanning S1 over the first display region 10B and the second display region 10C continuously, for example. This allows for successive and smooth transition, from the first pixel row to the last pixel row, of a region subjected to light emission within the display region 10A in one frame.

The drive circuit 20 may cause a transition speed of each of the light emission scanning S5 and the light extinction scanning S1 to be faster than a transition speed of each of the Vth correction scanning S2, the write scanning S3, and the waiting scanning S4 in each of the first display region 10B and the second display region 10C. In other words, the drive circuit 20 may cause the transition speed of each of the Vth correction scanning S2, the write scanning S3, and the waiting scanning S4 to be slower than the transition speed of each of the light emission scanning S5 and the light extinction scanning S1 in each of the first display region 10B and the second display region 10C. The drive circuit 20 may cause transition of each of the light emission scanning S5 and the light extinction scanning S1 to be performed at the transition speed twice the transition speed of each of the Vth correction scanning S2, the write scanning S3, and the waiting scanning S4 for each of the first display region 10B and the second display region 10C. In other words, the drive circuit 20 may cause transition of each of the Vth correction scanning S2, the write scanning S3, and the waiting scanning S4 to be performed at the transition speed half the transition speed of each of the light emission scanning S5 and the light extinction scanning S1 for each of the first display region 10B and the second display region 10C. As illustrated in (A) and (B) of FIG. 4 and (A) to (I) in FIG. 5, the drive circuit 20 may perform each of the light emission scanning S5 and the light extinction scanning S1 in a 1/2H cycle, and may perform each of the Vth correction scanning S2, the write scanning S3, and the waiting scanning S4 in a 1H cycle, for example. This allows the transition speed of each of the Vth correction scanning S2, the write scanning S3, and the waiting scanning S4 to be half a speed of transition performed on the undivided display region 10A.

The waiting period becomes shorter in a manner of Δt1, Δt2, Δt3, Δt4, and so on, as it goes from the first pixel row to the M/2th pixel row as illustrated in (A) to (I) of FIG. 5. The waiting period becomes shorter likewise as it goes from the M/2+1th pixel row to the M-th pixel row. These acts, including setting the waiting time and varying the setting time for each pixel row, are made possible by virtue of the gate-source voltage Vgs of the drive transistor Tr1 maintained at a constant value by the retention capacitor Cs during the waiting period.

The drive circuit 20 performs the scanning operations as described above, whereby such an image illustrated in (C) of FIG. 4 is obtained at the time Tx denoted in (A) and (B) of FIG. 4, for example. More specifically, at the time Tx, an image belonging to the n-th frame is displayed on the final scanned row in the first display region 10B, and an image belonging to the n-th frame is displayed on the first scanned row in the second display region 10C. The image belonging to the n-th frame displayed in the first display region 10B and the image belonging to the n-th frame displayed in the second display region 10C are displayed continuously at respective regions near a boundary (a dividing line L) at which the display region 10A is divided into the first display region 10B and the second display region 10C.

[Effect]

A description is now given of example effects of the display unit 1 according to the present embodiment.

Figure 13:
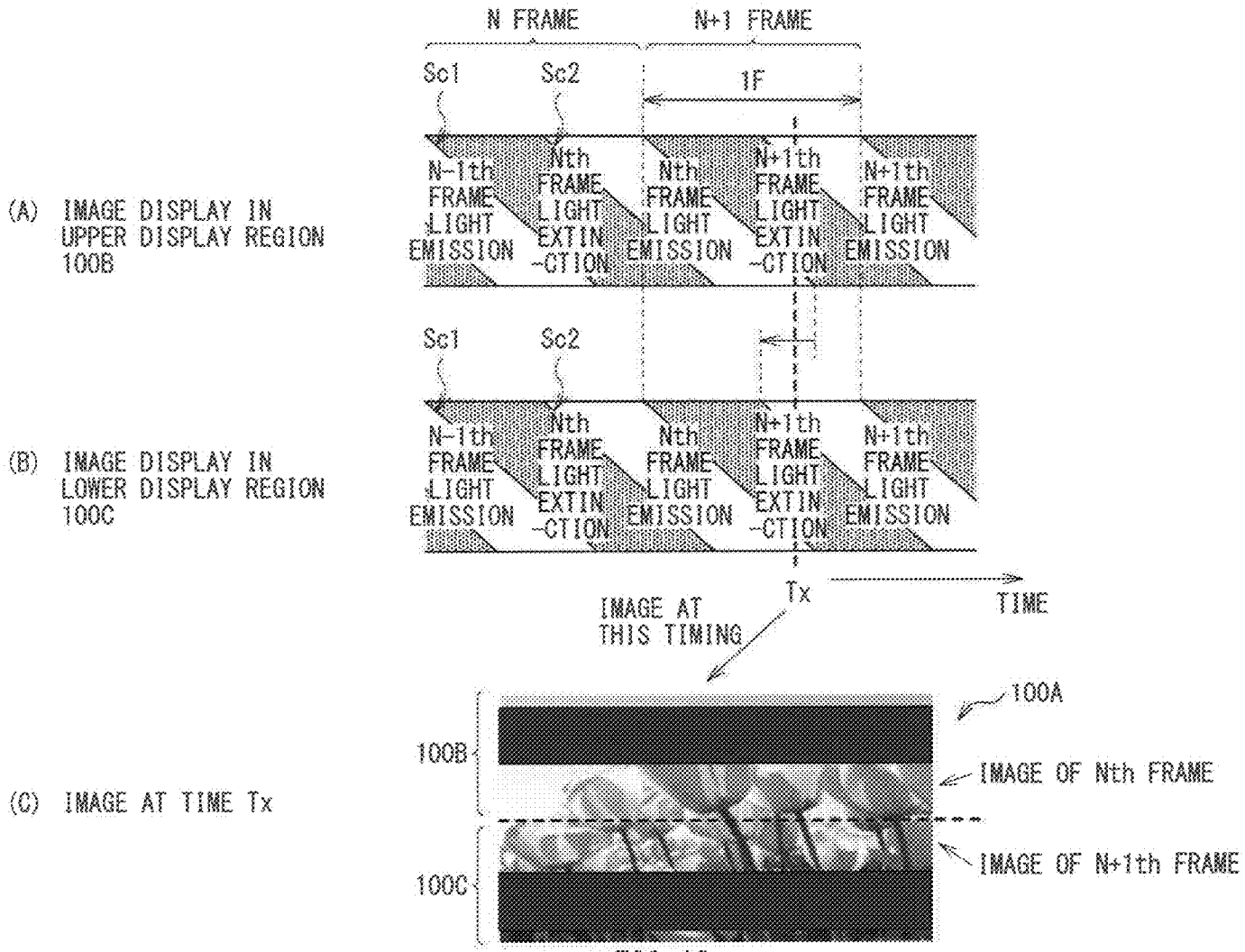
FIG. 13 illustrates an example of image display in each of upper and lower display regions where a display region is divided into two regions of the upper display region and the lower display region, according to a comparative example.

Parts (A) to (C) of FIG. 13 illustrate an example of image display in each of an upper display region (display region 100B) and a lower display region (display region 100C) where a display region 100A of a display unit according to a comparative example is divided into two regions of the upper display region 100B and the lower display region 100C. In FIG. 13, there is timing Tx at which images belonging to different frames from each other are displayed together at respective regions near a juncture (a part denoted by a broken line in (C) of FIG. 13) of the upper display region 100B and the lower display region 100C. At this time, the image may become discontinuous at the juncture described above when the image is a video image, leading to deterioration of quality of the displayed image.

In contrast, in the present embodiment, the timing of starting the light emission of the n+1th frame for the first scanned row in the second display region 10C is later than the timing of ending the light emission of the n-th frame for the final scanned row in the first display region 10B. This makes it possible to reduce deterioration of quality of a displayed image due to the discontinuity of the images at the dividing line L. Hence, it is possible to reduce deterioration of quality of a displayed image resulting from higher resolution.

Also, the transition speed of each of the Vth correction scanning S2, the write scanning S3, and the waiting scanning S4 may be made slower than the transition speed of each of the light emission scanning S5 and the light extinction scanning S1 in each of the first display region 10B and the second display region 10C. Hence, it is possible to ensure time for performing the Vth correction even with shortened 1H time attributed to higher definition and larger screen.

2. Modification Examples

Hereinafter, a description is given of various modification examples of the display unit 1 in the example embodiment described above. Note that the same or equivalent elements as those of the display unit 1 in the example embodiment described above are denoted with the same reference numerals, and will not be described in detail.

First Modification Example

Figure 6:
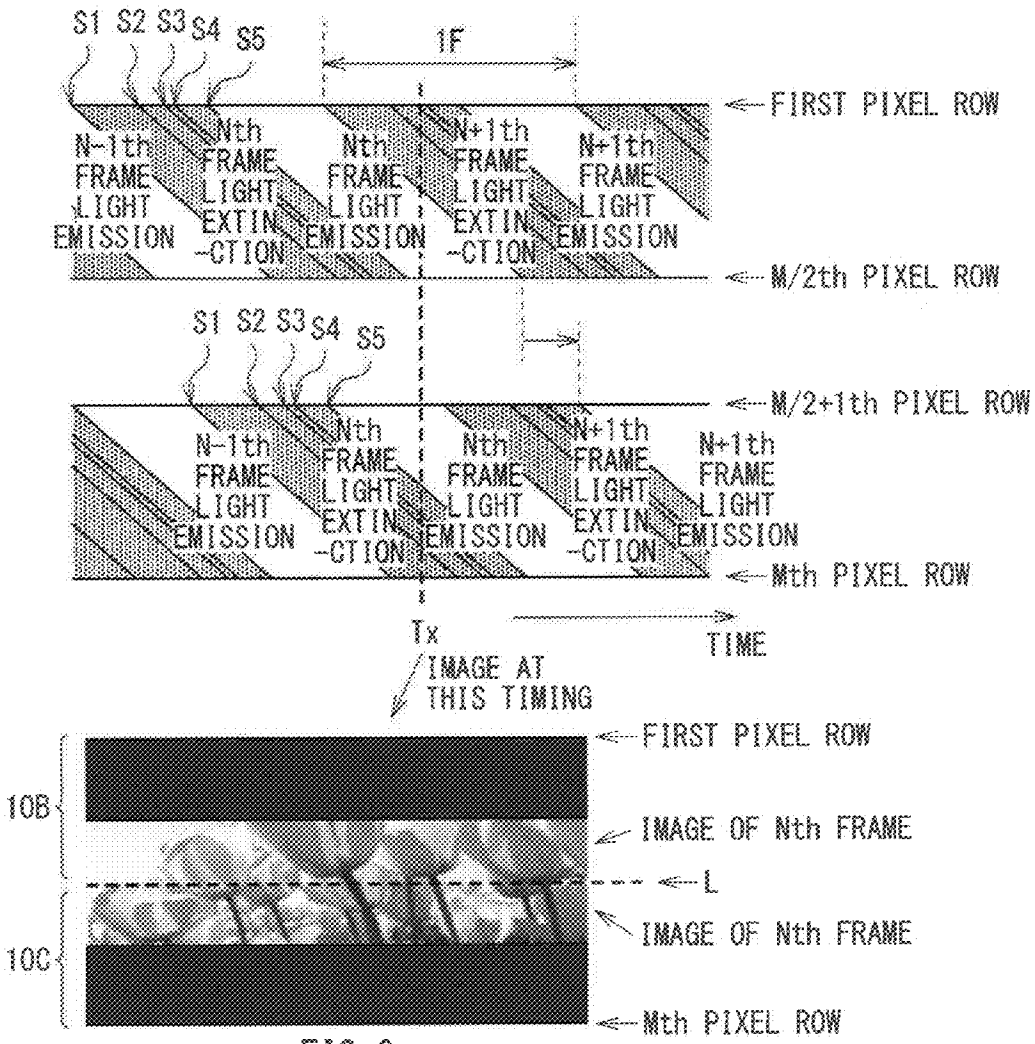
FIG. 6 illustrates an example of image display in each of the upper and lower display regions where the display region is divided into two regions of the upper display region and the lower display region, according to a modification example.

FIG. 6 illustrates an example of image display in each of the upper display region (first display region 10B) and the lower display region (second display region 10C) where the display region 10A is divided into two regions of the upper display region and the lower display region, according to a modification example. In the present modification example, the transition of each of the Vth correction scanning S2, the write scanning S3, and the waiting scanning S4 is performed at the transition speed same as the transition speed of each of the light emission scanning S5 and the light extinction scanning S1 in each of the first display region 10B and the second display region 10C. Such a driving method is also adoptable in any embodiment where time for performing the Vth correction is ensured.

Second Modification Example

Figure 7:
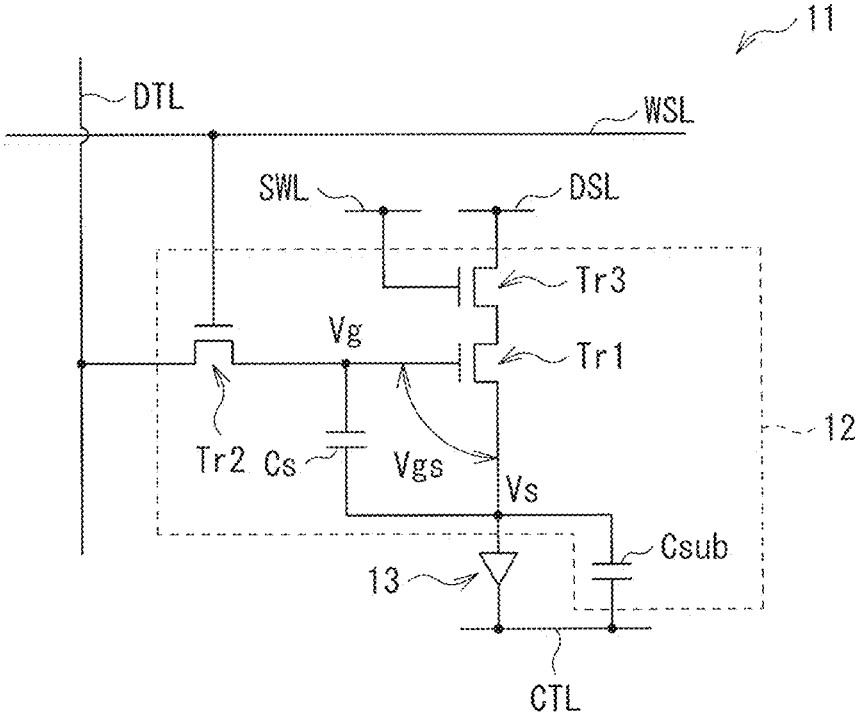
FIG. 7 illustrates an example of a circuit configuration of each pixel according to a modification example.

In any of the example embodiments described above, a switching transistor Tr3 may be inserted between the drive transistor Tr1 and the power line DSL as illustrated in FIG. 7. A gate of the switching transistor Tr3 is connected to a switching line SWL.

In the present modification example, the scan line driving circuit 24 performs on-off control of the switching transistor Tr3 through the switching line SWL. The power line driving circuit 25 may apply a predetermined voltage to each of the power lines DSL, and may be capable of outputting the voltage Vcc, for example. The scan line driving circuit 24 turns the switching line SWL on during a period in which the voltage Vss is applied to the power line DSL in any embodiment described above.

Third Modification Example

In the example embodiments and the modification examples described above, the display region 10A is divided into two regions (i.e., the first display region 10B and the second display region 10C). However, the display region may be divided into three or more regions. In such a modification example, the drive circuit 20 may perform the vertical scanning operations described in any of the example embodiments and the modification examples on two regions adjacent to each other in the vertical direction.

Fourth Modification Example

In the example embodiments and the modification examples described above, a light-emitting element other than an organic EL element may be provided in place of the organic EL element 13. Examples of the light-emitting element may include, for example but not limited to, an inorganic EL element, a light-emitting diode (LED), and a semiconductor laser.

3. Application Examples

Hereinafter, application examples of the display unit 1 described in any of the foregoing embodiment and the modification examples are described. The display unit 1 according to any of the above-described embodiment and the modification examples is applicable to a display unit of an electronic apparatus in any field that displays an image signal input from the outside or an image signal internally generated as an image or a picture. Non-limiting examples of the electronic apparatus may include, but not limited to, a television apparatus, a digital camera, a notebook personal computer, a mobile terminal device such as a mobile phone, and a video camera.

First Application Example

Figure 8:
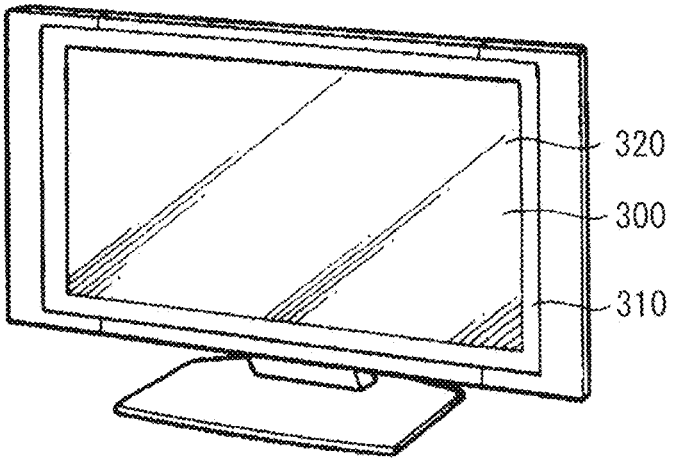
FIG. 8 is a perspective view illustrating appearance of a first application example of the display unit according to any embodiment of the technology.

FIG. 8 illustrates appearance of a television apparatus to which the display unit 1 according to any of the above-described embodiment and the modification examples is applied. For example, the television apparatus may have an image display screen section 300 that includes a front panel 310 and a filter glass 320. The image display screen section 300 is configured of the display unit 1 according to any of the above-described embodiment and the modification examples.

Second Application Example

Figure 9A:
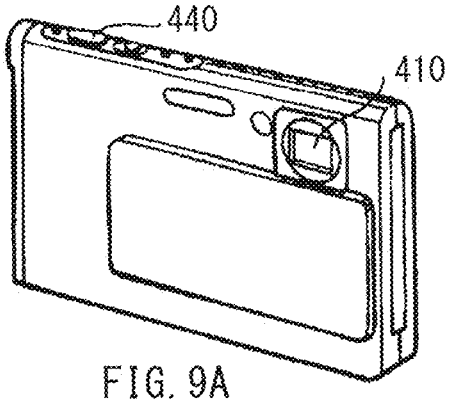
FIG. 9A is a perspective view illustrating appearance of a second application example as seen from the front.
Figure 9B:
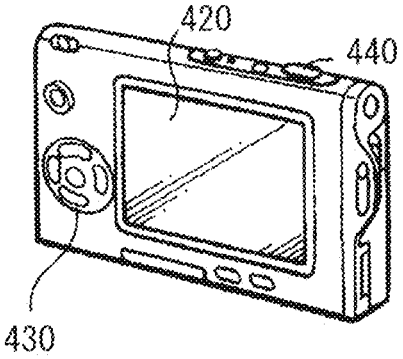
FIG. 9B is a perspective view illustrating appearance of the second application example as seen from the back.

FIG. 9A and FIG. 9B each illustrate appearance of a digital camera to which the display unit 1 according to any of the above-described embodiment and the modification examples is applied. For example, the digital camera may include a light emitting section 410 for flash, a display section 420, a menu switch 430, and a shutter button 440. The display section 420 is configured of the display unit 1 according to any of the above-described embodiment and the modification examples.

Third Application Example

Figure 10:
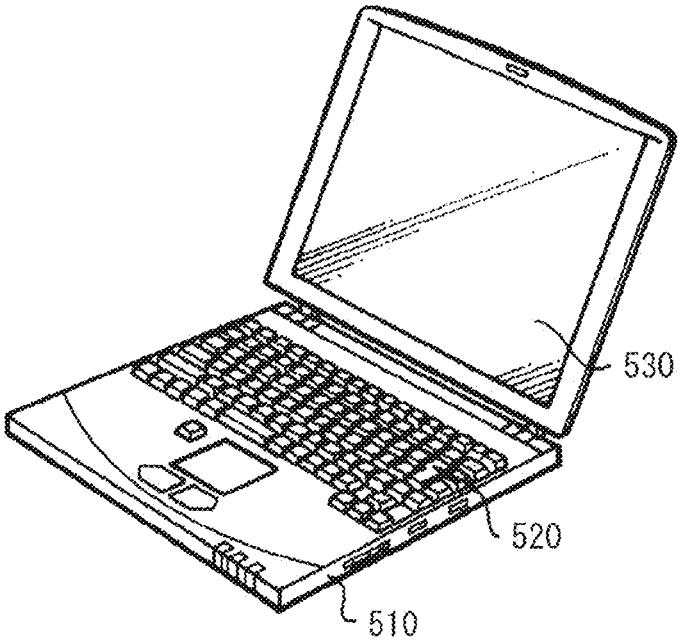
FIG. 10 is a perspective view illustrating appearance of a third application example.

FIG. 10 illustrates appearance of a notebook personal computer to which the display unit 1 according to any of the above-described embodiment and the modification examples is applied. For example, the notebook personal computer may have a main body 510, a keyboard 520 for input operation of characters and the like, and a display section 530 configured to display an image. The display section 530 is configured of the display unit 1 according to any of the above-described embodiment and the modification examples.

Fourth Application Example

Figure 11:
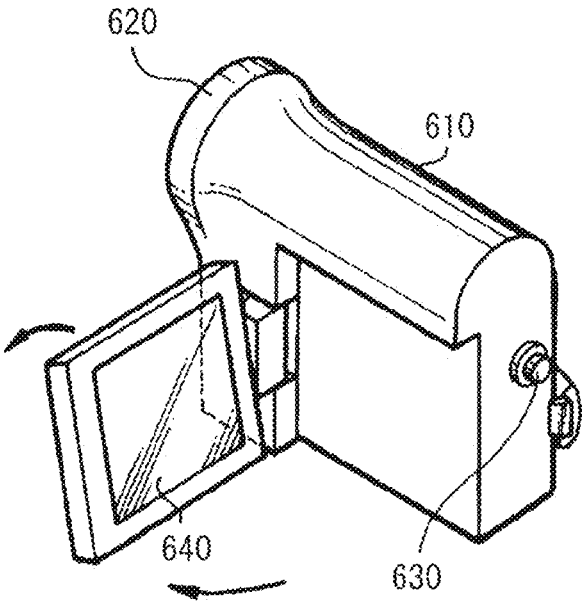
FIG. 11 is a perspective view illustrating appearance of a fourth application example.

FIG. 11 illustrates appearance of a video camera to which the display unit 1 according to any of the above-described embodiment and the modification examples is applied. For example, the video camera may include a main body section 610, a lens 620 that is provided on a front side surface of the main body section 610 and is used to shoot an object, a shooting start-stop switch 630, and a display section 640. The display section 640 is configured of the display unit 1 according to any of the above-described embodiment and the modification examples.

Fifth Application Example

Figure 12A:
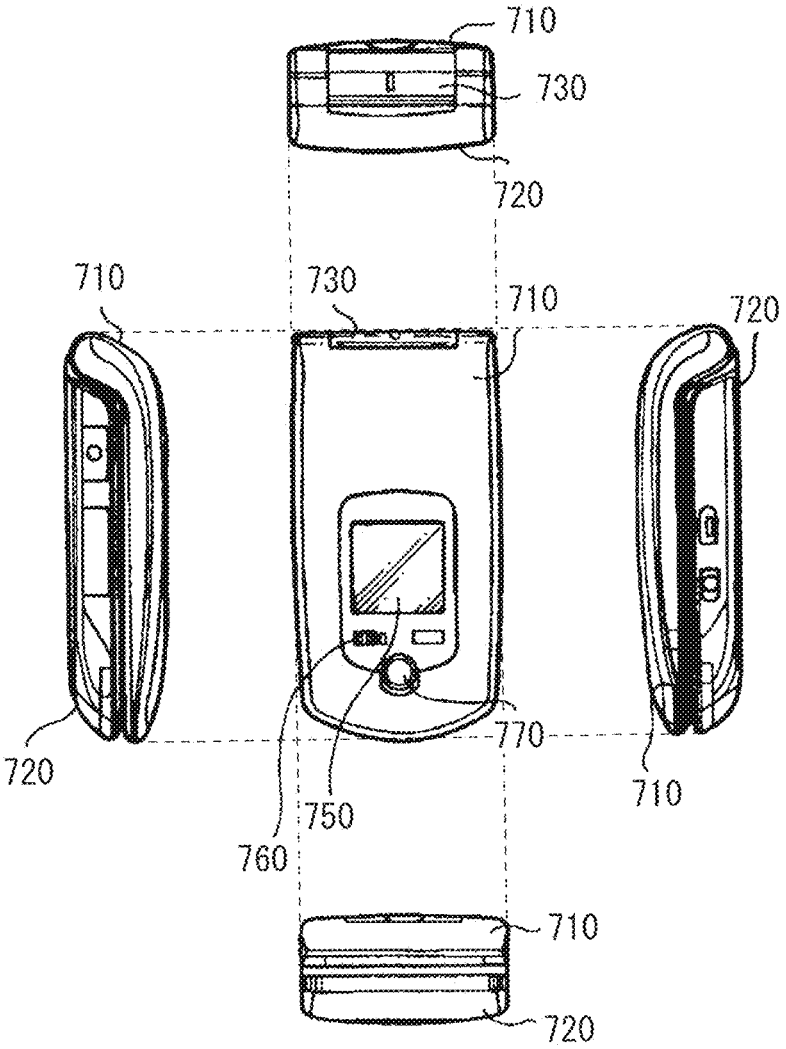
FIG. 12A illustrates appearance of a fifth application example in a closed state, as seen from the front, the left side, the right side, the top, and the bottom.
Figure 12B:
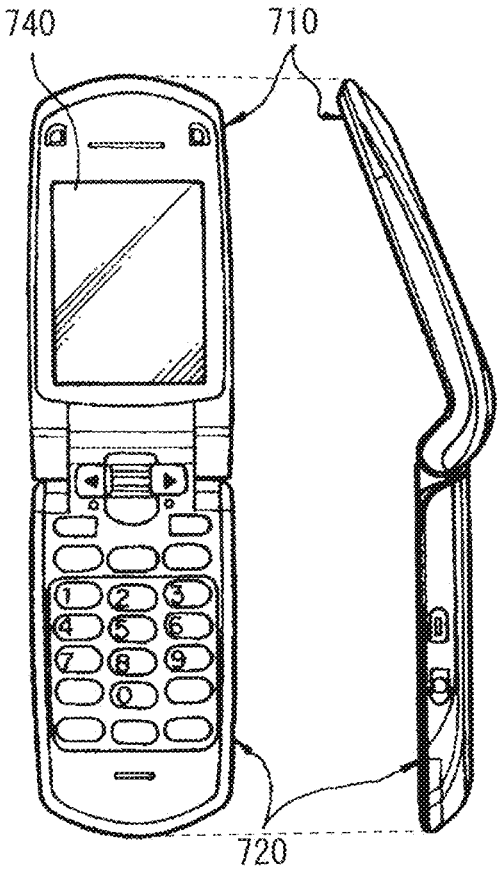
FIG. 12B illustrates appearance of the fifth application example in an open state, as seen from the front and the side.

FIG. 12A and FIG. 12B each illustrate appearance of a mobile phone to which the display unit 1 according to any of the above-described embodiment and the modification examples is applied. For example, the mobile phone may have a configuration in which an upper housing 710 and a lower housing 720 are coupled to each other through a connection section (a hinge section) 730, and may include a display 740, a sub-display 750, a picture light 760, and a camera 770. The display 740 or the sub-display 750 is configured of the display unit 1 according to any of the above-described embodiment and the modification examples.

Hereinbefore, although the technology has been described with reference to the example embodiment, the modification examples, and the application examples, the technology is not limited to the above-described embodiment and the like, and various modifications may be made.

For example, the configuration of the pixel circuit 12 for the active matrix driving is not limited to that described in the above-described embodiment and the modification examples, and a capacitor and a transistor may be added as necessary. In such an embodiment, necessary drive circuits may be added in addition to the signal line driving circuit 23, the scan line driving circuit 24, the power line driving circuit 25, and the like described above, based on modification of the pixel circuit 12.

Moreover, in the above-described embodiment and the modification examples, the driving of the signal line driving circuit 23, the scan line driving circuit 24, and the power line driving circuit 25 are controlled by the timing generating circuit 21 and the image signal processing circuit 22. In one embodiment, however, other circuits may control the driving thereof. Moreover, the control of the signal line driving circuit 23, the scan line driving circuit 24, and the power line driving circuit 25 may be performed based on hardware (circuits) or software (programs).

Furthermore, in the above-described embodiment and the modification examples, the source and the drain of the write transistor Tr2 and the source and the drain of the drive transistor Tr1 are described as being fixed. However, opposed relation between the source and the drain may be inverted as compared with the opposed relation described above, depending on the flowing direction of the current. In such a case, the source may be read as the drain and the drain may be read as the source in the above-described embodiment and the modification examples.

Moreover, in the above-described embodiment and the modification examples, each of the write transistor Tr2 and the drive transistor Tr1 is described as being formed by an n-channel MOS TFT. However, one or both of the write transistor Tr2 and the drive transistor Tr1 may be a p-channel MOS TFT. In one embodiment where the drive transistor Tr1 is a p-channel MOS TFT, the anode of the organic EL element 13 becomes the cathode and the cathode of the organic EL element 13 becomes the anode in the above-described embodiment and the modification examples. Also, in the above-described embodiment and the modification examples, each of the write transistor Tr2 and the drive transistor Tr1 does not necessarily have to be an amorphous-silicon-based TFT or a micro-silicon-based TFT. One or both of the write transistor Tr2 and the drive transistor Tr1 may be other suitable TFT such as, but not limited to, a low-temperature-polysilicon-based TFT or an oxide semiconductor TFT.

Further, effects described in the example embodiments and the modifications are illustrative. Effects achieved by the technology may be those that are different from the above-described effects, or may include other effects in addition to those described above.

Furthermore, the technology encompasses any possible combination of some or all of the various embodiments described herein and incorporated herein.

It is possible to achieve at least the following configurations from the above-described example embodiments of the disclosure.

(1) A drive circuit, including a scanning circuit configured to perform a first vertical scanning and a second vertical scanning on each of a first display region and a second display region individually in one frame, the first display region and the second display region being adjacent to each other in a vertical direction in a display region including a plurality of pixels, the first vertical scanning causing light emission of each of the pixels to be performed, and the second vertical scanning causing light extinction of each of the pixels to be performed, the scanning circuit being configured to perform the first vertical scanning and the second vertical scanning to cause timing of starting the light emission of an n+1th frame for a first scanned row in the second display region to be later than timing of ending the light emission of an n-th frame for a final scanned row in the first display region, the first scanned row being adjacent to the first display region, and the final scanned row being adjacent to the second display region.

(2) The drive circuit according to (1), wherein the scanning circuit performs the first vertical scanning and the second vertical scanning to cause a period of the light emission of the n-th frame for the final scanned row and a period of the light emission of an n-th frame for the first scanned row to be entirely or partially overlapped with each other.

(3) The drive circuit according to (1) or (2), wherein the scanning circuit performs, in a period after the light extinction by the second vertical scanning and before the light emission by the first vertical scanning, a third vertical scanning and a fourth vertical scanning on each of the first display region and the second display region individually in the one frame, the third vertical scanning causing a voltage based on an image signal to be written into each of the pixels, and the fourth vertical scanning following the third vertical scanning and causing each of the pixels to wait to perform the light emission.

(4) The drive circuit according to (3), wherein the scanning circuit causes a speed of transition of each of the first vertical scanning and the second vertical scanning to be faster than a speed of transition of each of the third vertical scanning and the fourth vertical scanning.

(5) The drive circuit according to (4), wherein the display region includes the first display region and the second display region, and the scanning circuit causes the transition of each of the first vertical scanning and the second vertical scanning to be performed at the speed of the transition twice the speed of the transition of each of the third vertical scanning and the fourth vertical scanning.

(6) A display unit, including:

a display panel having a display region, the display region including a plurality of pixels, and a first display region and a second display region that are adjacent to each other in a vertical direction; and a drive circuit configured to drive the pixels, and including a scanning circuit, the scanning circuit being configured to perform a first vertical scanning and a second vertical scanning on each of the first display region and the second display region individually in one frame, the first vertical scanning causing light emission of each of the pixels to be performed, and the second vertical scanning causing light extinction of each of the pixels to be performed, and the scanning circuit being configured to perform the first vertical scanning and the second vertical scanning to cause timing of starting the light emission of an n+1th frame for a first scanned row in the second display region to be later than timing of ending the light emission of an n-th frame for a final scanned row in the first display region, the first scanned row being adjacent to the first display region, and the final scanned row being adjacent to the second display region.

(7) The display unit according to (6), wherein the scanning circuit performs, in a period after the light extinction by the second vertical scanning and before the light emission by the first vertical scanning, a third vertical scanning and a fourth vertical scanning on each of the first display region and the second display region individually in the one frame, the third vertical scanning causing a voltage based on an image signal to be written into each of the pixels, and the fourth vertical scanning following the third vertical scanning and causing each of the pixels to wait to perform the light emission.

(8) The display unit according to (7), wherein each of the pixels includes:

a light-emitting element; and a pixel circuit configured to retain the voltage written into each of the pixels by the third vertical scanning.

(9) An electronic apparatus, including a display unit, the display unit including a display panel having a display region, the display region including a plurality of pixels, and a first display region and a second display region that are adjacent to each other in a vertical direction, and a drive circuit configured to drive the pixels, and including a scanning circuit, the scanning circuit being configured to perform a first vertical scanning and a second vertical scanning on each of the first display region and the second display region individually in one frame, the first vertical scanning causing light emission of each of the pixels to be performed, and the second vertical scanning causing light extinction of each of the pixels to be performed, and the scanning circuit being configured to perform the first vertical scanning and the second vertical scanning to cause timing of starting the light emission of an n+1th frame for a first scanned row in the second display region to be later than timing of ending the light emission of an n-th frame for a final scanned row in the first display region, the first scanned row being adjacent to the first display region, and the final scanned row being adjacent to the second display region.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A drive circuit comprising:

a time generating circuit configured to output a control signal; and a scanning circuit configured to receive the control signal, responsive to receiving the control signal, perform a first vertical scanning and a second vertical scanning on a first display region in each frame of a plurality of frames, the first display region includes a first plurality of scanned rows, the first vertical scanning includes a first signal that causes light emission of a final scanned row of the first plurality of scanned rows of the first display region and the second vertical scanning includes a second signal that causes light extinction of the final scanned row of the first display region, and responsive to receiving the control signal, perform the first vertical scanning and the second vertical scanning on a second display region in the each frame of the plurality of frames, the second display region includes a second plurality of scanned rows, the first vertical scanning includes a third signal that causes light emission of a first scanned row of the second plurality of scanned rows of the second display region and the second vertical scanning includes a fourth signal that causes light extinction of the first scanned row of the second display region, wherein a timing of the third signal is earlier than a timing of the first signal, wherein a timing of the fourth signal is earlier than a timing of the second signal, wherein the second display region is separate and adjacent to the first display region in a vertical direction in a display region including a plurality of pixels, wherein a timing of starting the light emission of an n+1 th frame of the plurality of frames for the first scanned row in the second display region is later than a timing of ending the light emission of an n-th frame of the plurality of frames for the final scanned row in the first display region, the first scanned row being adjacent to the first display region, and the final scanned row being adjacent to the second display region, and wherein n is a positive integer.

2. The drive circuit according to claim 1, wherein a period of the light emission of the n-th frame for the final scanned row and a period of the light emission of an n-th frame for the first scanned row are entirely or partially overlapped with each other.

3. The drive circuit according to claim 1, wherein the scanning circuit performs, in a period after the light extinction by the second vertical scanning and before the light emission by the first vertical scanning, a third vertical scanning and a fourth vertical scanning on each of the first display region and the second display region individually in the each frame of the plurality of frames, the third vertical scanning causing a voltage based on an image signal to be written into each of the plurality of pixels, and responsive to performing the third vertical scanning, the fourth vertical scanning causing the each of the plurality of pixels to wait to perform the light emission caused by the first vertical scanning.

4. The drive circuit according to claim 3, wherein the scanning circuit is configured to cause a speed of a transition of each of the first vertical scanning and the second vertical scanning to be faster than a speed of a transition of each of the third vertical scanning and the fourth vertical scanning.

5. The drive circuit according to claim 4, wherein the scanning circuit is configured to cause the speed of the transition of the each of the first vertical scanning and the second vertical scanning to be performed at twice the speed of the transition of the each of the third vertical scanning and the fourth vertical scanning.

6. A display unit comprising:

a display panel having a display region that includes a plurality of pixels, the display region including a first display region and a second display region that is separate and adjacent to the first display region in the display region in a vertical direction, the first display region including a first plurality of scanned rows, and the second display region including a second plurality of scanned rows; and a drive circuit configured to drive the plurality of pixels, the drive circuit including a scanning circuit that is configured to perform a first vertical scanning and a second vertical scanning on the first display region in each frame of a plurality of frames, the first vertical scanning includes a first signal that causes light emission of a final scanned row of the first plurality of scanned rows of the first display region and the second vertical scanning includes a second signal that causes causing light extinction of the final scanned row of the first display region, and perform the first vertical scanning and the second vertical scanning on the second display region in the each frame of the plurality of frames, the first vertical scanning includes a third signal that causes light emission of a first scanned row of the second plurality of scanned rows of the second display region and the second vertical scanning includes a fourth signal that causes light extinction of the first scanned row of the second display region, wherein a timing of the third signal is earlier than a timing of the first signal, wherein a timing of the fourth signal is earlier than a timing of the second signal, wherein a timing of starting the light emission of an n+1 th frame of the plurality of frames for the first scanned row in the second display region is later than a timing of ending the light emission of an n-th frame of the plurality of frames for the final scanned row in the first display region, the first scanned row being adjacent to the first display region, and the final scanned row being adjacent to the second display region, and wherein n is a positive integer.

7. The display unit according to claim 6, wherein the scanning circuit performs, in a period after the light extinction by the second vertical scanning and before the light emission by the first vertical scanning, a third vertical scanning and a fourth vertical scanning on each of the first display region and the second display region individually in the each frame of the plurality of frames, the third vertical scanning causing a voltage based on an image signal to be written into each of the plurality of pixels, and responsive to performing the third vertical scanning, the fourth vertical scanning causing the each of the plurality of pixels to wait to perform the light emission caused by the first vertical scanning.

8. The display unit according to claim 7, wherein the each of the plurality of pixels includes:

a light-emitting element; and a pixel circuit configured to retain the voltage written into the each of the plurality of pixels by the third vertical scanning.

9. The display unit according to claim 7, wherein the scanning circuit is configured to cause a speed of a transition of each of the first vertical scanning and the second vertical scanning to be faster than a speed of a transition of each of the third vertical scanning and the fourth vertical scanning.

10. The display unit according to claim 9, wherein the scanning circuit is configured to cause the speed of the transition of the each of the first vertical scanning and the second vertical scanning to be performed at twice the speed of the transition of the each of the third vertical scanning and the fourth vertical scanning.

11. The display unit according to claim 6, wherein a period of the light emission of the n-th frame for the final scanned row and a period of the light emission of an n-th frame for the first scanned row are entirely or partially overlapped with each other.

12. The display unit according to claim 6, wherein the drive circuit further includes a time generating circuit that is configured to output a control signal, and wherein the scanning circuit is further configured to receive the control signal, responsive to receiving the control signal, perform the first vertical scanning and the second vertical scanning on the first display region in the each frame of the plurality of frames, and responsive to receiving the control signal, perform the first vertical scanning and the second vertical scanning on the second display region in the each frame of the plurality of frames.

13. An electronic apparatus comprising:

a display unit that includes a display panel having a display region that includes a plurality of pixels, the display region including a first display region and a second display region that is separate and adjacent to the first display region in the display region in a vertical direction, the first display region including a first plurality of scanned rows, and the second display region including a second plurality of scanned rows, and a drive circuit configured to drive the plurality of pixels, the drive circuit including a scanning circuit that is configured to perform a first vertical scanning and a second vertical scanning on the first display region in each frame of a plurality of frames, the first vertical scanning includes a first signal that causes light emission of a final scanned row of the first plurality of scanned rows of the first display region and the second vertical scanning includes a second signal that causes light extinction of the final scanned row of the first display region, and perform the first vertical scanning and the second vertical scanning on the second display region in the each frame of the plurality of frames, the first vertical scanning includes a third signal that causes light emission of a first scanned row of the second plurality of scanned rows of the second display region and the second vertical scanning includes a fourth signal that causes light extinction of the first scanned row of the second display region, wherein a timing of the third signal is earlier than a timing of the first signal, wherein a timing of the fourth signal is earlier than a timing of the second signal, wherein a timing of starting the light emission of an n+1 th frame of the plurality of frames for the first scanned row in the second display region is later than a timing of ending the light emission of an n-th frame of the plurality of frames for the final scanned row in the first display region, the first scanned row being adjacent to the first display region, and the final scanned row being adjacent to the second display region, and wherein n is a positive integer.

14. The electronic apparatus according to claim 13, wherein a period of the light emission of the n-th frame for the final scanned row and a period of the light emission of an n-th frame for the first scanned row are entirely or partially overlapped with each other.

15. The electronic apparatus according to claim 13, wherein the scanning circuit performs, in a period after the light extinction by the second vertical scanning and before the light emission by the first vertical scanning, a third vertical scanning and a fourth vertical scanning on each of the first display region and the second display region individually in the each frame of the plurality of frames, the third vertical scanning causing a voltage based on an image signal to be written into each of the plurality of pixels, and responsive to performing the third vertical scanning, the fourth vertical scanning causing the each of the plurality of pixels to wait to perform the light emission caused by the first vertical scanning.

16. The electronic apparatus according to claim 15, wherein the scanning circuit is configured to cause a speed of a transition of each of the first vertical scanning and the second vertical scanning to be faster than a speed of a transition of each of the third vertical scanning and the fourth vertical scanning.

17. The electronic apparatus according to claim 16, wherein the scanning circuit is configured to cause the speed of the transition of the each of the first vertical scanning and the second vertical scanning to be performed at twice the speed of the transition of the each of the third vertical scanning and the fourth vertical scanning.

18. The electronic apparatus according to claim 15, wherein the each of the plurality of pixels includes:

a light-emitting element; and a pixel circuit configured to retain the voltage written into the each of the plurality of pixels by the third vertical scanning.

19. The electronic apparatus according to claim 13, wherein the drive circuit further includes a time generating circuit that is configured to output a control signal, and wherein the scanning circuit is further configured to receive the control signal, responsive to receiving the control signal, perform the first vertical scanning and the second vertical scanning on the first display region in the each frame of the plurality of frames, and responsive to receiving the control signal, perform the first vertical scanning and the second vertical scanning on the second display region in the each frame of the plurality of frames.

* * * * *